United States Patent [19]

Trask

[11] Patent Number: 4,562,607

[45] Date of Patent: Jan. 7, 1986

[54] SHOE STIFFENER

[75] Inventor: Blair D. Trask, Haverhill, Mass.

[73] Assignee: Bixby International Corporation, Newburyport, Mass.

[21] Appl. No.: 663,422

[22] Filed: Oct. 22, 1984

Related U.S. Application Data

[60] Division of Ser. No. 518,040, Jul. 28, 1983, which is a continuation-in-part of Ser. No. 314,722, Oct. 26, 1981, and Ser. No. 485,389, Apr. 15, 1983.

[51] Int. Cl.[4] ..... A43B 23/16; B29C 27/04

[52] U.S. Cl. ..... 12/146 D; 36/68; 36/45; 156/272.4

[58] Field of Search ..... 36/58, 68, 69, 76 R, 36/76 C, 77 M, 1, 22 A, 44, 30 R; 128/595, 82.1, 89 R; 156/272.4; 12/146 D

[56] References Cited

U.S. PATENT DOCUMENTS

| | | | |
|---|---|---|---|
| 3,305,884 | 2/1967 | Sullivan | 36/76 C |
| 3,620,875 | 11/1971 | Guglielmo | 156/272 |
| 3,778,251 | 12/1973 | Trask | 36/68 |
| 3,892,078 | 7/1975 | Closson Jr. | 36/68 |
| 3,946,193 | 3/1976 | Giese | 36/44 |
| 3,961,124 | 6/1976 | Matton | 36/68 |
| 4,015,347 | 4/1977 | Morishita et al. | 36/44 |
| 4,035,547 | 7/1977 | Heller Jr. et al. | 428/329 |
| 4,069,602 | 1/1978 | Kremer et al. | 36/68 |

FOREIGN PATENT DOCUMENTS

| | | | |
|---|---|---|---|
| 26145 | 3/1976 | Japan | 156/272.4 |
| 6811765 | 2/1970 | Netherlands | 156/272.4 |

*Primary Examiner*—Henry S. Jaudon
*Assistant Examiner*—Steven N. Meyers

[57] ABSTRACT

Heat-activating shoe stiffeners containing magnetic material by means of a high-frequency magnetic field.

3 Claims, 2 Drawing Figures

SHOE STIFFENER

RELATION TO OTHER APPLICATIONS

This is a divisional of my previous application, namely: U.S. Ser. No. 518,040, "Shoe Stiffener", filed July 28, 1983, which is a continuation-in-part of my two previous applications, namely: U.S. Ser. No. 314,722, "Shoe Stiffener", filed Oct. 26, 1981 and U.S. Ser. No. 485,389, "Shoe Stiffener", filed Apr. 15, 1983.

BACKGROUND OF THE INVENTION

Footwear frequently includes reinforcing members, e.g., counters, which stiffen heel regions. Such a member is often a thermoplastic material and is formed to the desired shape after placing the member in a shoe subassembly and heating to cause softening.

SUMMARY OF THE INVENTION

My invention provides an improvement in a thermoplastic reinforcing member for footwear which allows the member to be heated and formed without the heating of other, possibly sensitive, shoe portions. The improvement includes magnetic material dispersed throughout the member, the material upon exposure to a high-frequency magnetic field of an induction heating coil causing the heating and softening of the member to permit its being formed into a desired shape.

In preferred embodiments the magnetic material is magnetic iron oxide powder present in the thermoplastic member amount 25 to 35 percent by weight; the member includes a coating of heat-activated adhesive; and the adhesive is activated under the conditions under which the member is softened. Because the need to consider heating characteristics is reduced, the reinforcing member can contain virtually any thermoplastic material having characteristics desired for a given application. The magnetic field frequency and time of exposure are chosen to cause the desired softening of the thermoplastic material and adhesive used. Preferred range is 1 to 10 MegaHertz; most preferred is 1 to 2 MegaHertz.

PREFERRED EMBODIMENT

I turn now to a description of the drawings and the structure and operation of a preferred embodiment.

DRAWINGS

STRUCTURE

Figure 1:
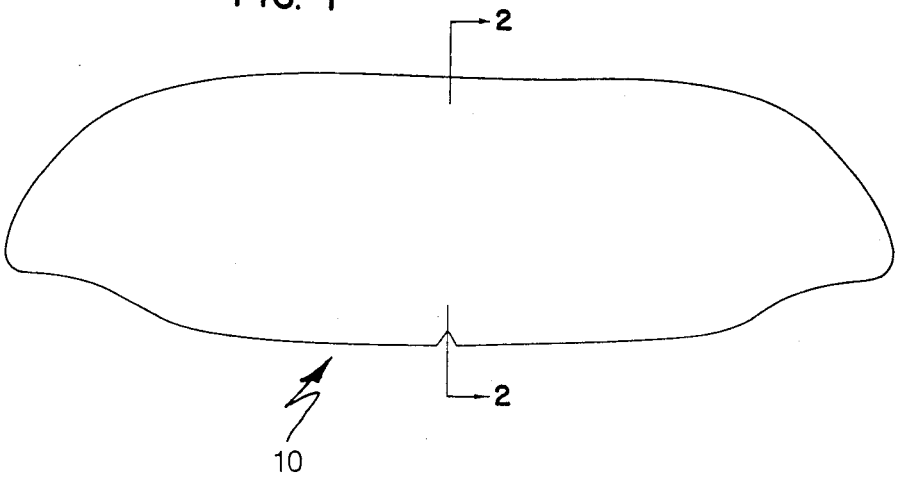
FIG. 1 is a perspective view of a shoe counter of the invention.
Figure 2:
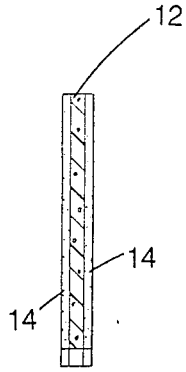
FIG. 2 is a cross-sectional view of the counter of FIG. 1.

Referring to FIG. 1, flat, counter-shaped, 0.040 in. thick sheet 10 includes 0.04 in. plastic layer 12 and adhesive layers 14.

Plastic layer 12 has the following composition:

| Components | Percent by Weight |
|---|---|
| High Density Polyethylene (density .958–.062) (Melt Index .25–1.25) | 42.5 |
| Ethylene Vinyl Acetate Copolymer (18–20% Vinyl Acetate) (Melt Index 6–50) | 25.0 |
| Magnetic Iron Oxide such as Magna float D from Foote | 32.5 |

-continued

| Components | Percent by Weight |
|---|---|
| Mineral Company | |

Layer 12 is formed by mixing the iron oxide powder into a liquid or semi-liquid mixture of polyethylene and the ethylene vinyl acetate copolymer, forming the mixture into a sheet using conventional techniques, and finally cutting the counter to shape using conventional techniques.

Heat-activated adhesive layers 14 are deposited using conventional coating techniques.

OPERATION

A shoe upper subassembly containing (in the usual manner, sewed into U-shape) counter 10 is exposed to the high frequency magnetic field (1.2 MegaHertz) of induction heating apparatus having a U-shaped coil of 2½" radius for insertion thereinto of the upper subassembly.

The magnetic field causes the iron oxide particles in plastic layer 12 to heat sheet 10, so that counter 10 becomes soft and can be conformed to the desired shape of heel. At the same time, the heat melts adhesive 14, so that counter 10 may be adhered to the inside of the upper and lining.

OTHER EMBODIMENTS

Other embodiments are within the following claims.

The stiffener may be a box toe blank.

For example, the thermoplastic material used in the reinforcing member can be any suitable material or mixture of materials; the choice will vary, depending on desired properties; e.g., degree of stiffness.

Similarly, the magnetic particle component can vary, depending on the application. Generally, the magnetic component comprises between about 15 and 25% of the reinforcing member, by weight. Iron oxide or iron may be used alone as well as together, and the particle size of both can be varied; larger particles may have a tendency to affect physical properties of the plastic more than small particles.

As examples, other suitable thermoplastic-containing reinforcing members have the following compositions:

| | Components | Percent by Weight |
|---|---|---|
| 1. | Surlyn 1605 | 80 |
| | Iron powder | 10 |
| | Iron oxide | 10 |
| 2. | Surlyn 1605 | 72 |
| | Iron powder | 20 |
| | Styrene maleic anhydride copolymer (Dylark 232, Arco Chemical) | 8 |
| 3. | High density polyethylene (Grade LB-742, U.S. Industrial Chemical) | 80 |
| | Iron powder | 20 |
| 4. | Low density polyethylene (Grade NA-226, U.S. Industrial Chemical) | 85 |
| | Iron oxide | 15 |
| 5. | Polypropylene (Grade 8523, Hercules) | 85 |
| | Iron powder | 15 |
| 6. | 8 oz. napped | 75 |

-continued

| Components | Percent by Weight |
|---|---|
| cotton flannel fabric impregnated to a dry weight add on of 300% with 85/15 Styrene/Butadiene: latex | (dry weight) |
| Iron oxide | 15 |

For counters, the thickness of the plastic-containing layer will normally range between about 0.020 in. and 0.060 in. The thickness of the adhesive coating will normally range between about 0.003 in. and 0.005 in.

Other embodiments within the following claims will occur to those skilled in the art.

What is claimed is:

1. The method of stiffening a shoe which comprises providing a shoe stiffener comprising a mixture of plastic resin and 25% to 35% by weight magnetic material, and activating said shoe stiffener through imposition of a high frequency magnetic field provided by a coil shaped to conform to the shape of said stiffener at frequency between 1 and 10 MegaHertz.

2. The method of claim 3 in which said frequency is in the range of 1 to 2 MegaHertz.

3. The method of claim 2 in which said frequency is 1.2 MegaHertz.

* * * * *

UNITED STATES PATENT AND TRADEMARK OFFICE

CERTIFICATE OF CORRECTION

PATENT NO. : 4,562,607

DATED : January 7, 1986

INVENTOR(S) : Blair D. Trask

It is certified that error appears in the above-identified patent and that said Letters Patent are hereby corrected as shown below:

Column 4, line 11, "3" should be --1--.

Signed and Sealed this

*Twenty-fifth* Day of *March 1986*

[SEAL]

*Attest:*

DONALD J. QUIGG

*Attesting Officer*

*Commissioner of Patents and Trademarks*